US006427463B1

(12) United States Patent
James

(10) Patent No.: US 6,427,463 B1
(45) Date of Patent: Aug. 6, 2002

(54) METHODS FOR INCREASING EFFICIENCY IN MULTIPLE-TEMPERATURE FORCED-AIR REFRIGERATION SYSTEMS

(75) Inventor: Timothy W. James, Solana Beach, CA (US)

(73) Assignee: TES Technology, Inc., Ventura, CA (US)

( * ) Notice: Subject to any disclaimer, the term of this patent is extended or adjusted under 35 U.S.C. 154(b) by 0 days.

(21) Appl. No.: 09/505,390

(22) Filed: Feb. 16, 2000

Related U.S. Application Data

(60) Provisional application No. 60/120,469, filed on Feb. 17, 1999, and provisional application No. 60/132,774, filed on May 6, 1999.

(51) Int. Cl.[7] ..... F25D 17/04; F25D 11/02

(52) U.S. Cl. ..... 62/186; 62/432; 62/198; 62/278

(58) Field of Search ..... 62/186, 180, 198, 62/179, 187, 434, 431, 432, 441, 277, 278

(56) References Cited

U.S. PATENT DOCUMENTS 2,937,511 A 5/1960 Mann ..... 62/186 X
4,416,119 A 11/1983 Wilson et al. ..... 62/186 X
4,712,387 A 12/1987 James et al. ..... 62/434
4,756,164 A 7/1988 James et al. ..... 62/119
5,239,839 A 8/1993 James ..... 62/434

*Primary Examiner*—Harry B. Tanner
(74) *Attorney, Agent, or Firm*—Blakely, Sokoloff, Taylor & Zafman LLP

(57) ABSTRACT

A method using controlled forced-convection to couple (or de-couple) a refrigerant-evaporator thermally to a refrigerated compartment, and a method to use heat from a fresh food compartment (or other compartment maintained above 0C) of a two or more temperature refrigeration appliance to defrost a freezer evaporator automatically without using a controller or heater. When thermally coupled to its compartment, an evaporator can provide efficient cooling to the compartment. The ability to de-couple the evaporator from its compartment enables refrigerant flow through the evaporator at significantly different temperatures than its compartment, but without significant heat transfer. This ability enables using a single refrigeration system (with one or no valves) to remove heat (sequentially) at two or more different temperatures from two or more refrigerated compartments.

21 Claims, 2 Drawing Sheets

METHODS FOR INCREASING EFFICIENCY IN MULTIPLE-TEMPERATURE FORCED-AIR REFRIGERATION SYSTEMS

This is a non-provisional United States (U.S.) patent application based on two provisional U.S. patent applications including (i) a first provisional U.S. patent application entitled "Method For Increasing Efficiency In Multiple-Temperature Forced-Air Refrigeration Systems" (app. Ser. No. 60/120,469; filed Feb. 17, 1999 and (ii) a second provisional U.S. patent application entitled "Method For Increasing Efficiency In Multiple-Temperature Forced-Air Refrigeration Systems" (app. Ser. No. 60/132,774; filed May 6, 1999.

BACKGROUND OF THE INVENTION

1. Field of the Invention

The present invention relates to the field of refrigeration.

2. Background of Art Related to the Invention

For many decades, domestic refrigerators have included a freezer section and a fresh food section. The fresh food section is maintained at a significantly higher temperature than the freezer section. While the basic laws of thermodynamics provide empirical evidence that it is increasingly more difficult to cool (i.e., remove heat from) an item as its temperature decreases, domestic refrigerators typically have been designed with more consideration focused on cost than thermodynamics. For example, many domestic refrigerators use a one-stage refrigeration system including a single evaporator located in the freezer section. Since the total heat load dissipation is through this single evaporator, this one-stage refrigeration system possesses less than optimal energy efficiency.

Recently, in order to increase system efficiency, some refrigerators have been constructed with two separate refrigeration systems; namely, one refrigeration system is responsible for cooling the freezer section while the other refrigeration system is responsible for cooling the fresh food section. Consequently, this dual refrigeration system includes repetitive condensing units, each featuring a compressor and a condenser. This repetition of equipment increases the cost and size of the refrigerator. Also, these repetitive condensing units produce a greater amount of noise.

Another example involves yacht refrigerators which have been implemented with refrigeration systems having valves to sequentially, but not simultaneously, connect a single, high-capacity condensing unit to multiple evaporators operating at differing temperatures. The refrigeration system may use thermal energy storage (TES) material to provide stable temperatures during the period between evaporator operations.

Preferably, TES material is an aqueous solution such as a salt solution having water and sodium chloride (NaCl). This composition provides high heat storage capacity, emits a large amount of heat isothermally upon changing phase from a liquid to a solid, is-non-toxic and can be produced for a low cost. Unfortunately, this TES material is highly corrosive to most metals, tends to expand when frozen which would damage the thin wall of the heat exchanger and tends to freeze first on the heat exchange surfaces which would hamper further heat transfer. This requires the TES material to be separated from the thin-walled metal tubing of the heat exchanger. One technique of separation involves encapsulating TES material into separate expandable capsules as described in U.S. Pat. No. 5,239,839 by the named inventor.

Additionally, the use of TES material adversely affects the efficiency of conventional defrosting cycles. The reason is that conventional defrost methods, if implemented, would require the entire TES material to melt before actual defrosting could begin.

U.S. Pat. Nos. 4,712,387 and 4,756,164 by the named inventor describe a heat pipe based method for efficiently transferring heat into and out of TES material and a method for thermally de-coupling the TES material from the cooled space to enable simple and efficient defrosting of the evaporator. These methods fail to provide any suggestion of the multi-stage refrigeration system and/or control protocol used to control this refrigeration system.

PCT International Patent Application No. PCT/US97/20151 describes a cost-effective evaporation unit and an energy efficient control protocol to maintain steady temperatures for each section of a refrigeration unit. An additional element of that disclosure is the use and design of a simple sensor for determining the frozen fraction of a TES module in order to control on-and-off cycling of the compressor for temperature stabilization.

SUMMARY OF THE INVENTION

The present invention comprises a method using controlled forced-convection to couple (or de-couple) a refrigerant-evaporator thermally to a refrigerated compartment. When thermally coupled to its compartment, an evaporator can provide efficient cooling to the compartment. The ability to de-couple the evaporator from its compartment enables refrigerant flow through the evaporator at significantly different temperatures than its compartment, but without significant heat transfer. This ability enables using a single refrigeration system (with no valves) to remove heat (sequentially) at two or more different temperatures from two or more refrigerated compartments. This capability enables achieving the maximum energy efficiency for the heat removal process from a multi-temperature system (e.g., a domestic refrigerator/freezer appliance) with a single refrigeration system.

The present invention also comprises a method to use heat from a fresh food compartment (or other compartment maintained above 0 C) of a two or more temperature refrigeration appliance to defrost a freezer evaporator automatically without using a controller or heater. The benefits of this innovation come from use of this innovation in conjunction with one of the frost-free methods also disclosed herein.

BRIEF DESCRIPTION OF THE DRAWINGS

The features and advantages of the present invention will become apparent from the following description of the present invention in which.

DESCRIPTION OF THE PREFERRED EMBODIMENT

Figure 1:
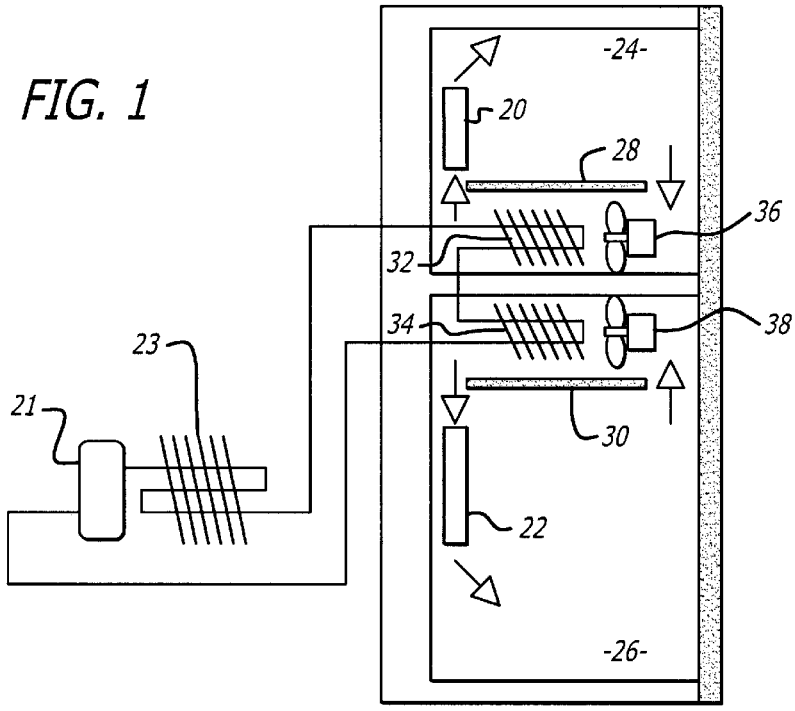
FIG. 1 presents an illustration of a simple two-temperature implementation of one aspect of the present invention.

The implementation of the present invention illustrated in FIG. 1 may use a thermal energy storage device 20 and 22 in either or both compartments 24 and 26, respectively. This implementation uses a single compressor 21 and condenser 23, and uses insulating barriers 28 and 30 to help isolate the evaporators 32 and 34 in each of their compartments from their compartment, except when the fan 36 or 38 is operating. This implementation achieves further isolation (when the fan is off) by having the lower temperature compartment 26 below the warmer temperature compartment 24. This configuration minimizes natural convection. For example when the fan 36 in the upper (higher temperature) compartment is on, the refrigerant temperature may be significantly higher than the temperature of the lower compartment 26. In this situation the portion of the refrigerant circuit in the lower compartment 26 will be warmer than the compartment and not establish free convection involving the lower compartment.

Figure 2:
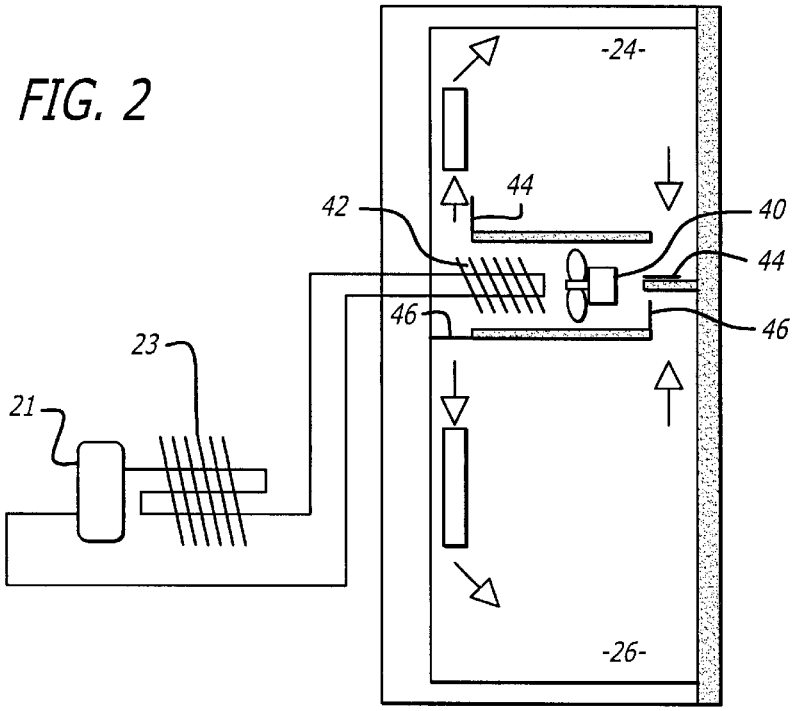
FIG. 2 presents an illustration of another implementation of one aspect of the present invention.

Another implementation appears in FIG. 2. In this case, a single compressor 21 and condenser 23 are used, and one or both thermal energy storage devices 20 and 22 may be used. There is only one fan 40 and one air/refrigerant heat exchange surface 42 (expansion device) and the thermal coupling (de-coupling) occurs by opening and closing flow passages 44 and 46 for air flow to either of the compartments 24 and 26. This method provides the same energy efficiency benefits that have motivated others to add multiple valves in the refrigerant circuit of a multiple temperature system so that multiple evaporators can be operated sequentially and independently. This new approach eliminates the cost, reliability, and energy consumption concerns often associated with multiple refrigerant valves.

Figure 3:
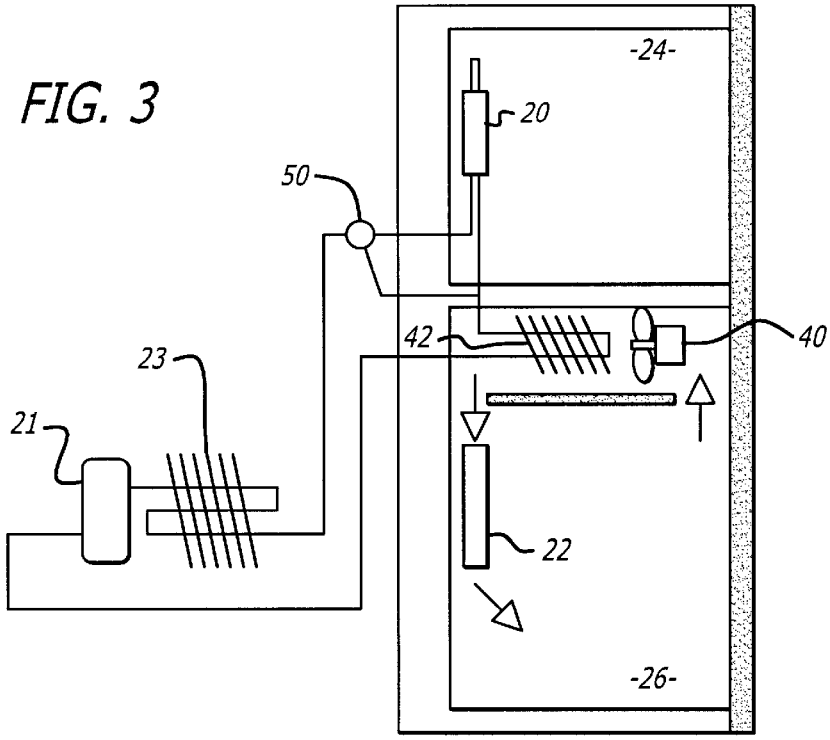
FIG. 3 presents an illustration of a defrost method in accordance with the present invention.

The capability of thermally disconnecting or connecting an evaporator 42 can be combined with a three-way refrigerant valve 50 as in FIG. 3 below. Here the motivation is to establish an integral connection of the thermal energy storage device (20 or 22) to the refrigerant in one of the refrigerated compartments 24 or 26. The desire for a better thermal connection between the thermal energy storage device (TES) and refrigerant or the desire to eliminate a second fan (including its power consumption and dissipation) may make this configuration desirable in some markets.

The benefits of this design include:

1. Enhanced energy efficiency, by removing heat from each compartment rather than allowing all the heat to flow to the lowest temperature for removal there.
2. Enhanced-efficiency de-frost of the freezer section evaporator. During operation of the fan in the higher temperature compartment, the refrigerant flowing through the section of the evaporator in the freezer compartment will heat this evaporator. This heating can offset the required heating to defrost this evaporator. In the configuration of FIG. 2 there is just one surface and it operates at both the low and higher temperature. Defrosting would be performed after operation at the higher temperature.
3. Isolation of the air in a refrigerator compartment from a freezer compartment, hence minimizing frost accumulation in the freezer and desiccation of the stored food in the refrigerator section,
4. Optional addition of TES to either or both compartments. The forced convection provided by the fan would provide thermal coupling between the evaporator and the TES. The TES could be positioned so that natural convection provides continuous coupling between the TES and the compartment.

The capability of thermally disconnecting or connecting an evaporator can be combined with a three-way refrigerant valve 50 as in FIG. 3 below. Here the motivation is to establish an integral connection of the thermal energy storage device to the (20 or 22) to the refrigerant in one of the refrigerated compartments 24 or 26. The desire for a better thermal connection between the thermal energy storage device TES and refrigerant or the desire to eliminate a second fan (including its power consumption and dissipation) may make this configuration desirable in some markets.

The foregoing is essentially a method to in effect, have another "valve" in the system so that one can achieve most of (or virtually all of) the "two stage" efficiency benefit to having dual refrigeration systems. This approach supports frost-free designs and has many advantages over the use of dual compressors, (as is often the case in European appliances). The fan, when on thermally connects the freezer box to the evaporator and when off, it is disconnected. TES if desired could be placed (widely distributed with very large surface area) throughout the compartment (e.g., compartment walls).

Figure 4:
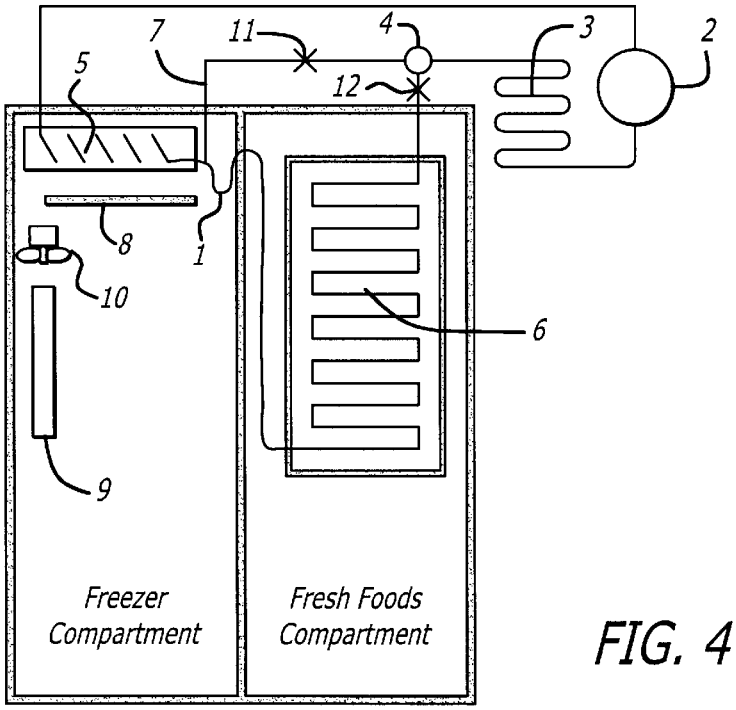
FIG. 4 presents an illustration of a defrost method in accordance with the present invention.

A defrost method in accordance with the present invention is illustrated in FIG. 4. In this Figure, the elements indicated by the numerals 1 through 12 are as follows:

1. Refrigerant tube between fresh foods evaporator with TES and no-frost forced convection evaporator in freezer compartment,
2. Compressor,
3. Condenser,
4. Three way valve directs refrigerant flow to be through both evaporators or only through the freezer evaporator,
5. Freezer evaporator,
6. Refrigerator evaporator (with integral TES)
7. Refrigerant tube for singular operation of freezer evaporator and not fresh foods evaporator,
8. Thermal barrier between freezer evaporator and freezer compartment
9. Freezer TES, heat removal by forced convection from the evaporator
10. Fan to thermally couple evaporator in freezer to freezer compartment when operated.
11. Expansion device for Freezer evaporator
12. Expansion device for refrigerator evaporator During the period when the compressor is not operating, heat transferred from the fresh-foods compartment to the evaporator in the freezer compartment will warm and eventually melt frost build up on its surfaces. Because there are long periods between compressor operation (owing to the extended cooling provided by TES) there is ample time to transfer heat and defrost the freezer evaporator. The desire for a long period of compressor off condition argues strongly for use of a TES module in the freezer section (as described in concept #3 in provisional application "Methods for increasing efficiency in multiple-temperature forced-air refrigeration systems" ). During the compressor off-time the freezer evaporator is thermally disconnected from the thermal mass of the freezer compartment and its contents (as described in Methods for increasing efficiency in multiple-temperature forced-air refrigeration systems). This allows the evaporator to warm up and defrost due to small amounts of heat transferred from the warmer compartment.

Heat transfer can be provided simply and economically by the existing tube 1. In particular, tube 1 can provide heat transfer by either conduction through the tube walls or by a thermal siphon (heat pipe effect) or a combination of the two. Additionally, arranging the air flow (either natural convection or forced) in the fresh foods section, so that it has appropriate heat transfer to the tube 1 in the fresh foods compartment will maintain the appropriate temperature of tube 1 at the point where it passes into the freezer compartment. The trap in tube 1 is an option to block the liquid refrigerant from freely flowing during compressor operation into the fresh food compartment while the three-way-valve directs refrigerant flow to the freezer evaporator through tube 7. Varying the height and position of the trap will vary the heat transfer provided by the thermal siphon effect.

Additional components required (relative to a conventional single evaporator Domestic US refrigerator/freezer):

1. TES evaporator in fresh foods section (can be "foamed in" the walls so essentially hidden)
2. Three-way valve to control the refrigerant flow and select proper expansion device.

The benefits (relative to a conventional single evaporator Domestic U.S. refrigerator/freezer) include:

1. Minimum energy used to defrost
2. Defrost energy used to cool the refrigerator section
3. Eliminate need for heater
4. Eliminate need for defrost controller
5. Permits a smaller evaporator in the freezer (As a result of having the higher efficiency two-stage system and elimination of the additional heat input traditionally supplied by a defrost heater.)
6. Smaller compressor (result of having higher efficiency with the two stage system)
7. No requirement for air passages between compartments (simpler design and assembly as well as cleaner internal design)

While the invention has been described with reference to illustrative embodiments, this description is not intended to be construed in a limiting sense. Various modifications of the illustrative embodiments, as well as other embodiments of the invention apparent to persons skilled in the art to which the invention pertains, are deemed to lie within the spirit and scope of the invention. Thus, the invention should be measured in terms of the claims which follow.

What is claimed is:

1. A method of efficiently refrigerating first and second compartments to first and second temperatures, the second temperature being lower than the first temperature, comprising:

providing a first evaporator in thermal communication with a first thermal energy storage material, the first thermal energy storage material being in thermal communication with the first compartment;

providing a second evaporator;

providing a controllable fan to circulate air between the second evaporator and the second compartment by forced convection;

and selectively:

providing refrigerant flow under pressure to the first evaporator and then through the second evaporator with the fan turned off to maintain the first temperature in the first compartment and remove heat from the first thermal energy storage material; and, providing refrigerant flow under pressure to the second evaporator with the fan turned on to maintain the second temperature in the second compartment.

2. The method of claim 1 wherein the first evaporator and the first thermal energy storage material are provided in an integral unit.

3. The method of claim 2 further comprising providing a second thermal energy storage material in thermal communication with the second compartment.

4. The method of claim 1 wherein providing refrigerant under pressure to the first evaporator and then through the second evaporator, and providing refrigerant under pressure to the second evaporator is accomplished by use of a three way valve.

5. The method of claim 1 wherein the first thermal energy storage material is a material using a change of phase between a liquid state and a solid state to store thermal energy.

6. The method of claim 1 wherein the first compartment is a refrigerator compartment and the second compartment is a freezer compartment.

7. The method of claim 6 further comprising a method of defrosting the second evaporator comprising coupling heat from the refrigerator compartment to melt frost build-up on the second evaporator when the refrigerant flow is off.

8. The method of claim 7 wherein heat is coupled from the refrigerator compartment to defrost the second evaporator by conduction.

9. The method of claim 7 wherein heat is coupled from the refrigerator compartment to defrost the second evaporator by a heat pipe effect.

10. The method of claim 7 wherein heat is coupled from the refrigerator compartment to defrost the second evaporator by a combination of conduction and a heat pipe effect.

11. The method of claim 1 further comprising placing a trap in the refrigerant line between the first and second evaporators.

12. A method of efficiently refrigerating first and second compartments to first and second temperatures, the second temperature being lower than the first temperature, comprising:

providing a first evaporator in thermal communication with a first thermal energy storage material, the first thermal energy storage material being in thermal communication with the first compartment;

providing a second evaporator;

providing a second thermal energy storage material in thermal communication with the second compartment;

providing a controllable fan to circulate air between the second evaporator and the second thermal energy storage material to controllably put the second evaporator in thermal communication with the second thermal energy storage material by forced convection;

and selectively:

providing refrigerant flow under pressure to the first evaporator and then through the second evaporator with the fan turned off to maintain the first temperature in the first compartment and remove heat from the first thermal energy storage material; and, providing refrigerant flow under pressure to the second evaporator and not the first evaporator with the fan turned on to maintain the second temperature in the second compartment and remove heat from the second thermal energy storage material.

13. The method of claim 12 wherein the first evaporator and the first thermal energy storage material are provided in an integral unit.

14. The method of claim 12 wherein providing refrigerant under pressure to the first evaporator and then through the second evaporator, and providing refrigerant under pressure to the second evaporator is accomplished by use of a three way valve.

15. The method of claim 12 wherein the first and second thermal energy storage materials are materials using a change of phase between a liquid state and a solid state to store thermal energy.

16. The method of claim 12 wherein the first compartment is a refrigerator compartment and the second compartment is a freezer compartment.

17. The method of claim 16 further comprising a method of defrosting the second evaporator comprising coupling heat from the refrigerator compartment to melt frost build-up on the second evaporator when the refrigerant flow is off.

18. The method of claim 17 wherein heat is coupled from the refrigerator compartment to defrost the second evaporator by conduction.

19. The method of claim 17 wherein heat is coupled from the refrigerator compartment to defrost the second evaporator by a heat pipe effect.

20. The method of claim 17 wherein heat is coupled from the refrigerator compartment to defrost the second evaporator by a combination of conduction and a heat pipe effect.

21. The method of claim 12 further comprising placing a trap in the refrigerant line between the first and second evaporators.

* * * * *